US010920155B2

(12) United States Patent
Suleiman et al.

(10) Patent No.: US 10,920,155 B2
(45) Date of Patent: Feb. 16, 2021

(54) FUEL CLEANING SYSTEM

(71) Applicant: General Electric Company, Schenectady, NY (US)

(72) Inventors: Baha Mahmoud Suleiman, Temple Terrace, FL (US); Obulesu Chatakonda, Khobar (SA); Eric William Cottell, Nassau (BS)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 16/511,658

(22) Filed: Jul. 15, 2019

(65) Prior Publication Data

US 2021/0017456 A1 Jan. 21, 2021

(51) Int. Cl.
*C10G 31/06* (2006.01)
*C10G 33/06* (2006.01)

(52) U.S. Cl.
CPC ..... *C10G 31/06* (2013.01); *C10G 33/06* (2013.01); *C10G 2300/1074* (2013.01); *C10G 2300/1077* (2013.01); *C10G 2300/4006* (2013.01); *C10G 2300/805* (2013.01)

(58) Field of Classification Search
CPC .. C10G 31/06; C10G 33/06; C10G 2300/805; C10G 2300/1074; C10G 2300/1077; C10G 2300/4006
See application file for complete search history.

(56) References Cited

U.S. PATENT DOCUMENTS

| | | | | |
|---|---|---|---|---|
| 7,930,998 | B2 | 4/2011 | Cottell | |
| 9,505,987 | B2 | 11/2016 | Francisco et al. | |
| 2003/0042174 | A1* | 3/2003 | Austin | B01D 17/04 208/187 |
| 2007/0215522 | A1* | 9/2007 | Inage | C10G 21/003 208/86 |
| 2016/0264878 | A1 | 9/2016 | Francisco et al. | |

* cited by examiner

*Primary Examiner* — Brian A McCaig
(74) *Attorney, Agent, or Firm* — Fletcher Yoder, P.C.

(57) ABSTRACT

A system that includes a fuel treatment system. The fuel treatment system includes a hydrodynamic cavitation reactor that receives a fluid that includes fuel from a fuel supply and water from a water supply. The hydrodynamic cavitation reactor cavitates the fluid. Cavitation of the fluid cracks the fuel and forms radicals that combine with one or more substances in the fuel. A separator receives the fluid and separates the fluid into water, fuel, and one or more substances.

20 Claims, 4 Drawing Sheets

FUEL CLEANING SYSTEM

BACKGROUND OF THE INVENTION

The subject matter disclosed herein relates to fuel cleaning systems.

Wells are drilled in subsea and surface locations to retrieve oil and natural gas from subterranean deposits. The oil retrieved from a well is typically referred to as crude oil. After retrieval, the crude oil is sent to refineries where the crude oil is processed into different fuels and products. The refinery processes the crude oil by separating the lighter hydrocarbons from the heavier hydrocarbons. For example, the refinery may separate the hydrocarbons into gasoline, diesel, lubricating oils, kerosene, and heavy fuel oil. Some of these heavier hydrocarbons are sold to power plants which burn these heavy oils as fuel in gas turbines and boilers to generate power. Heavy fuel oils are also referred to as Residual Fuel Oil. Unfortunately, the heavier fuel oils may have high concentrations of undesirable substances such as sulfur, vanadium and nickel. The burning of heavy fuel oil with high metal impurities concentrations produces undesirable emissions from gas turbine and boiler power plants.

BRIEF DESCRIPTION OF THE INVENTION

Certain embodiments commensurate in scope with the originally claimed invention are summarized below. These embodiments are not intended to limit the scope of the claimed invention, but rather these embodiments are intended only to provide a brief summary of possible forms of the invention. Indeed, the invention may encompass a variety of forms that may be similar to or different from the embodiments set forth below.

In one embodiment, a system that includes a fuel treatment system. The fuel treatment system includes a hydrodynamic cavitation reactor that receives a fluid that includes fuel from a fuel supply and water from a water supply. The hydrodynamic cavitation reactor cavitates the fluid. Cavitation of the fluid cracks the fuel and breaks water to form radicals that combine with one or more substances in the fuel. A separator receives the fluid and separates the fluid into water, fuel, and one or more substances.

In another embodiment, a system that includes a fuel treatment system. The fuel treatment system includes a first hydrodynamic cavitation reactor that receives a first fluid that includes fuel from a fuel supply and water from a water supply. The first hydrodynamic cavitation reactor cavitates the first fluid. Cavitation of the first fluid cracks the fuel, breaks water to form radicals that combine with one or more substances in the fuel. A first separator receives the first fluid from the first hydrodynamic cavitation reactor. The first separator separates one or more substances from the first fluid. A second hydrodynamic cavitation reactor receives water from the first separator. The second hydrodynamic cavitation reactor cavitates the water to remediate the water.

In another embodiment, a system that includes a gas turbine that drives a generator. A fuel supply that supplies fuel to the gas turbine and a water supply. A fuel treatment system removes substances from the fuel using water from the water supply. The fuel treatment system includes a hydrodynamic cavitation reactor that receives a fluid that includes fuel from the fuel supply and water from the water supply. The hydrodynamic cavitation reactor cavitates the fluid. Cavitation of the fluid cracks the fuel, breaks water to form radicals that combine with one or more substances in the fuel. A separator receives the fluid. The separator separates the fluid into water, fuel, and the one or more substances.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION OF THE INVENTION

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements.

As explained above, some fuels used in gas turbines, or other loads (e.g. boilers, engines) may contain high concentrations of undesirable substances such as sulfur, nickel and vanadium etc. The burning of fuel with high sulfur, nickel and vanadium concentrations produces undesirable emissions. The disclosure below describes a fuel treatment system used to remove undesirable substances from fuel using non-catalytic processes (e.g., non-chemical fuel treatment system). Specifically, the fuel treatment systems described below combine fuel with water and direct the combined fluid into a hydrodynamic cavitation reactor. The hydrodynamic cavitation reactor cavitates the fluid, which cracks the fuel while also producing radicals from the water (e.g., oxygen, hydrogen and hydroxyl radicals). By cracking the fuel, the hydrodynamic cavitation reactor may produce lighter hydrocarbons that may more readily combust in the combustion applications (e.g., gas turbine), while the radicals react with and oxidize undesirable substances in the fuel, such as sulfur, nickel and vanadium. Oxidizing these undesirable substances enables the fuel treatment system to remove them from the fluid in a gravity separator. The fuel may then be used in a gas turbine or other load and the undesirable substances properly disposed of. In this way, the fuel treatment system may reduce the amount of undesirable substances (e.g., sulfur, vanadium, nickel, calcium, iron) in the emissions of a gas turbine or other load.

Figure 1:
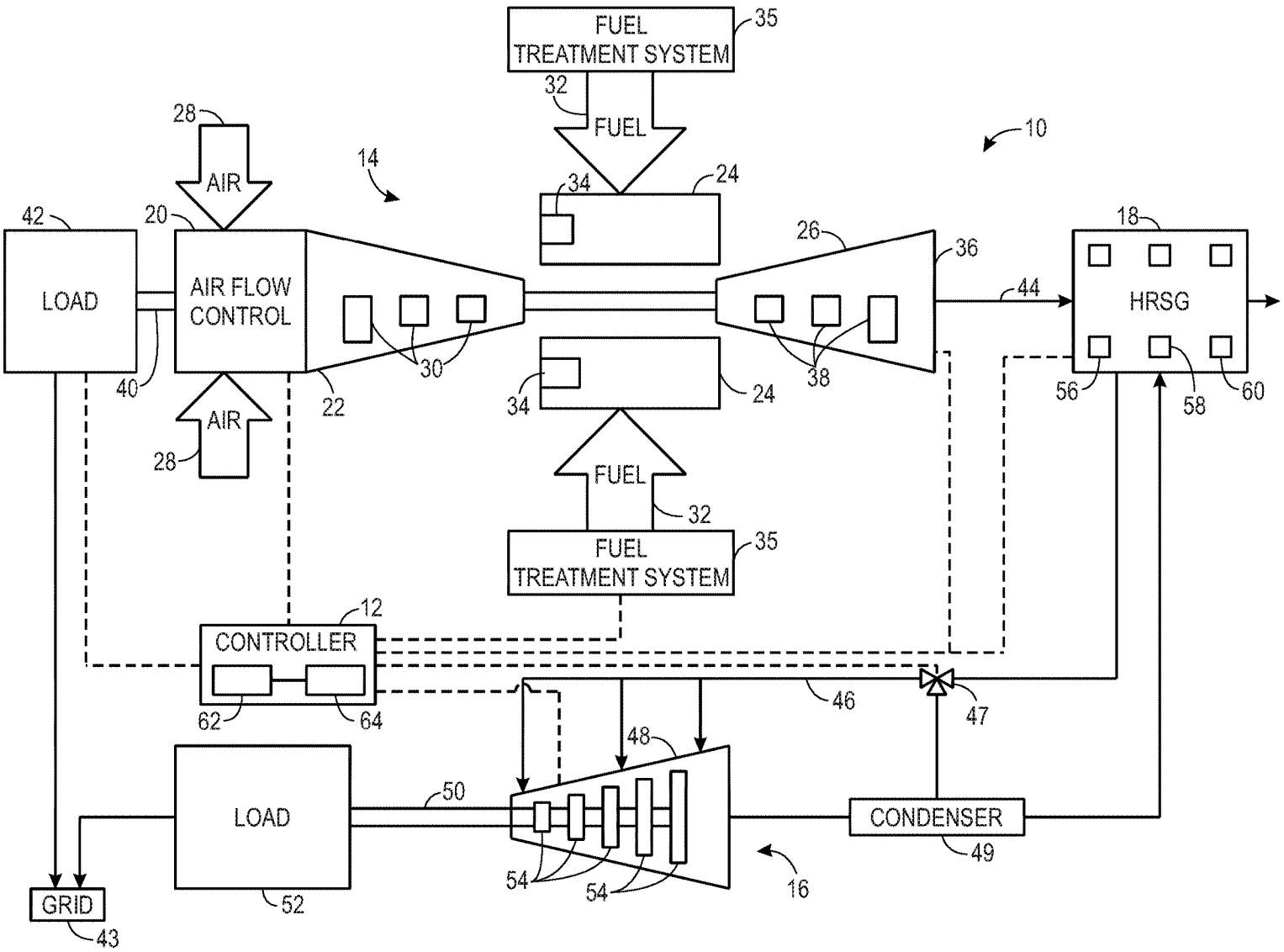
FIG. 1 is a block diagram of an embodiment of a combined cycle power plant system with a fuel treatment system, according to an embodiment of the disclosure.

FIG. 1, is a block diagram of an embodiment of a combined cycle power production system 10 with a control system 12 that provides for control operations of the combined cycle power production system 10. The combined cycle power production system 10 further includes a gas turbine system 14, a steam turbine system 16, and a heat recovery steam generator (HRSG) system 18. In operation, the gas turbine system 14 combust a fuel-air mixture to create torque that drives a load, e.g., an electrical generator. In order to reduce energy waste, the combined cycle power production system 10 uses the thermal energy in the exhaust gases to heat a fluid and create steam in the HRSG system 18. The steam travels from the HRSG system 18 through a steam turbine system 16 creating torque that drives a load, e.g., an electrical generator. Accordingly, the combined cycle power production system 10 combines the gas turbine system 14 with steam turbine system 16 to increase power production while reducing energy waste (e.g., thermal energy in the exhaust gas).

The gas turbine system 14 includes an airflow control system 20, compressor 22, combustor 24, and turbine 26. In operation, an oxidant 28 (e.g., air, oxygen, oxygen enriched air, or oxygen reduced air) enters the gas turbine system 14 through the airflow control system 20, which controls the amount of oxidant flow (e.g., airflow). The airflow control system 20 may control airflow by heating the oxidant flow, cooling the oxidant flow, extracting airflow from the compressor 22, using an inlet restriction, using an inlet guide vane, or a combination thereof. As the air passes through the airflow control system 20, the air enters the compressor 22. The compressor 22 pressurizes the air 28 in a series of compressor stages (e.g., rotor disks 30) with compressor blades. As the compressed air exits the compressor 22, the air enters the combustor 24 and mixes with fuel 32. For example, the fuel nozzles 34 may inject a fuel-air mixture into the combustor 24 in a suitable ratio for more optimal combustion, emissions, fuel consumption, and power output. As depicted, a plurality of fuel nozzles 34 intakes the fuel 32, mixes the fuel 32 with air, and distributes the air-fuel mixture into the combustor 24. The air-fuel mixture combusts in a combustion chamber within combustor 24, thereby creating hot pressurized exhaust gases. The fuel 32 is treated with a fuel treatment system 35. As will be explained below, the fuel treatment system 35 removes undesirable substances from the fuel, such as sulfur nickel and/or vanadium, which reduces the amount of these substances in the emissions from the gas turbine system 14.

After combustion, the combustor 24 directs the exhaust gases through a turbine 26 toward an exhaust outlet 36. As the exhaust gases pass through the turbine 26, the gases contact turbine blades attached to turbine rotor disks 38 (e.g., turbine stages). As the exhaust gases travel through the turbine 26, the exhaust gases may force turbine blades to rotate the rotor disks 38. The rotation of the rotor disks 38 induces rotation of shaft 40 and the rotor disks 38 in the turbine 26. A load 42 (e.g., electrical generator) connects to the shaft 40 and uses the rotation energy of the shaft 40 to generate electricity for use by an electric power grid 43.

As explained above, the combined cycle power production system 10 harvests energy from the hot exhaust gases exiting the gas turbine system 14 for use by the steam turbine system 16. Specifically, the combined cycle power production system 10 channels hot exhaust gases 44 from the gas turbine system 14 into the heat recovery steam generator (HRSG) 18 for further energy capture. In the HRSG 18, the thermal energy in the combustion exhaust gases converts water into hot pressurized steam. The HRSG 18 releases the steam for use in the steam turbine system 16.

The steam turbine system 16 includes a steam turbine 48, shaft 50, and load 52 (e.g., electrical generator). As the hot pressurized steam in line 46 enters the steam turbine 48, the steam contacts turbine blades attached to turbine rotor disks 54 (e.g., turbine stages). As the steam passes through the turbine stages in the steam turbine 48, the steam induces the turbine blades to rotate the rotor disks 54. The rotation of the rotor disks 54 induces rotation of the shaft 50. As illustrated, the load 52 (e.g., electrical generator) connects to the shaft 50. Accordingly, as the shaft 50 rotates, the load 52 (e.g., electrical generator) uses the rotation energy to generate electricity for the power grid 43. As the pressurized steam in line 46 passes through the steam turbine 48, the steam loses energy (i.e., expands and cools). After exiting the steam turbine 48, the steam enters a condenser 49 before being routed back to the HRSG 18, where the steam is reheated for reuse in the steam turbine system 16. It is to be noted that the HRSG 18 may include a variety of components, such as one or more boilers 56, attemperators 58, drums 60, and so on. For example, the boilers 56 may convert water into steam, while the attemperators 58 may adjust steam temperature, for example, by spraying water into the steam. Likewise, drums 60 may be used as repositories of water, steam, and the like. It is to be noted that the HRSG 18 may include other components, such as superheaters 61, deareators 63, economizers 65, and so on.

The control system 12 includes one or more memories 62 and one or more processors 64. The memory 62 stores instructions and steps written in software code. The processor 64 executes the stored instructions, for example, in response to feedback received from sensors in the combined cycle power production system 10. More specifically, the control system 12 controls and communicates with various components in the combined cycle power production system 10 in order to flexibly control the loading and unloading of the gas turbine system 14, and thus the loading and unloading of the steam turbine system 16, power production, steam production, and so on. In operation, the control system 12 may control the airflow control system 20 and the consumption of fuel 32 to change the loading of the gas turbine system 14 and thereby the loading of combined cycle power production system 10 (i.e., how the combined cycle power production system 10 increases electrical power output to the grid 43). For example, the control system 12 may adjust the mass flow rate and temperature of the exhaust gas 44, which controls how rapidly the HRSG 18 produces steam for the steam turbine system 16, and therefore, how quickly the combined cycle power production system 10 produces electrical power using loads 42 and 52. For example, when the control system 12 increases the airflow with the airflow control system 20, it increases the amount of airflow flowing through the compressor 22, flow through the combustor 24, and flow through the turbine 26. The increase in airflow increases the mass flow rate of the exhaust gas, and thus the torque of the shaft 40. Likewise, the airflow control system 20 may be used to reduce airflow flowing through the compressor 22, through the combustor 24, and flow through the turbine 26. The decrease in airflow decreases the mass flow rate of the exhaust gas, and thus the torque of the shaft 40.

The control system 12 may additionally control fuel consumption by the gas turbine system 14. Control of the fuel 32 affects the mass flow rate through the gas turbine system 14 and the thermal energy available for the HRSG 18. For example, when the controller system 12 increases fuel consumption the temperature of the exhaust gas 44 increases. The increase in the exhaust gas 44 temperature enables the HRSG 18 to produce steam at higher temperatures and pressures, which translates into more power production by the steam turbine system 16. However, when the control system 12 decreases fuel consumption there is a reduction in the temperature of the exhaust gas. Accordingly, there is less mechanical energy available to drive load 42 and less thermal energy available to produce steam for the steam turbine system 16 to drive load 52. In certain embodiments the control system 12 may be a distributed control system (DCS) where autonomous controllers are distributed throughout the combined cycle power production system 10.

Figure 2:
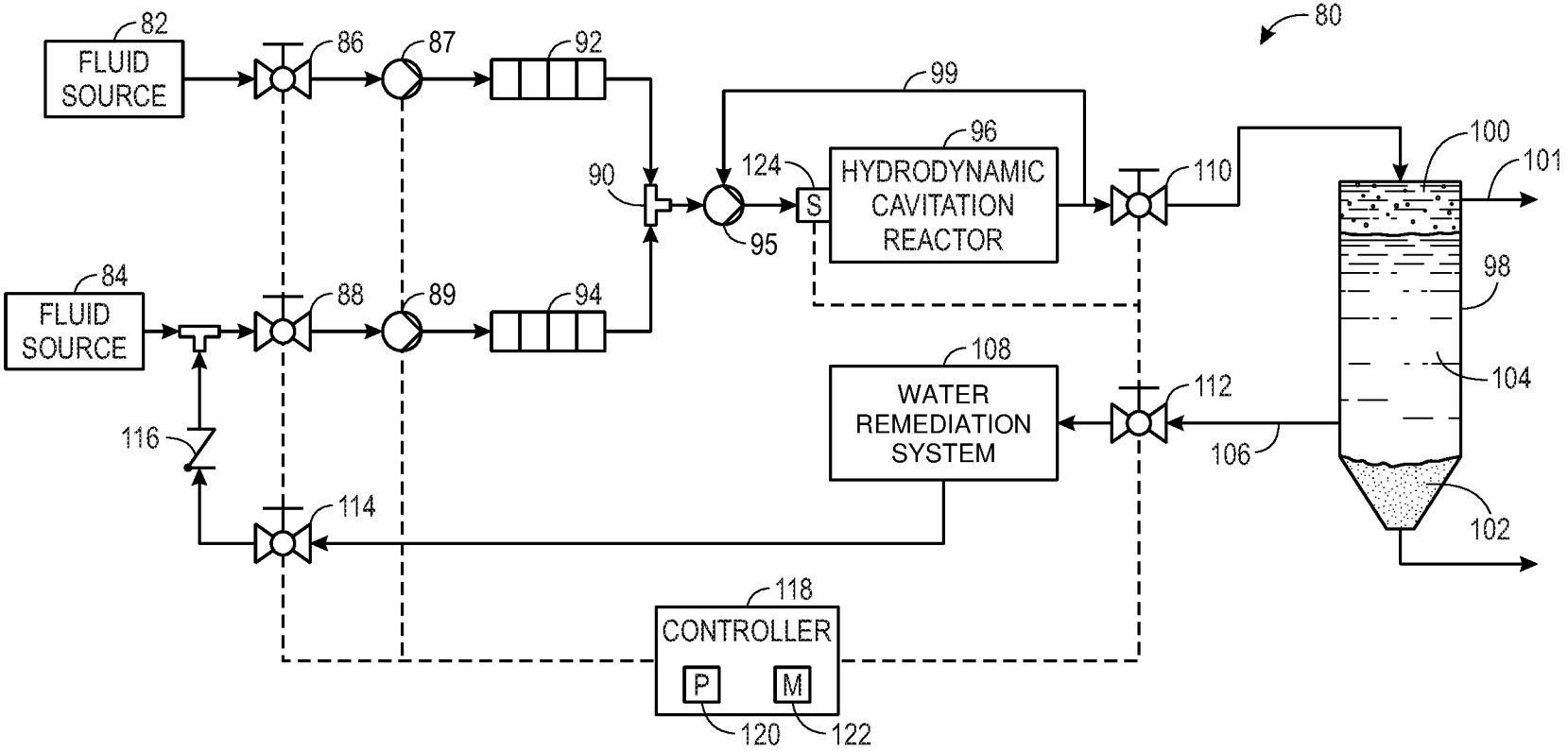
FIG. 2 is a schematic of a fuel treatment system, according to an embodiment of the disclosure.

FIG. 2 is a schematic of a fuel treatment system 80. The fuel treatment system 80 uses hydrodynamic cavitation to cavitate a fluid (e.g., heavy fuel oil, crude oil, bunker fuel). The water in the fluid may be the primary cavitation medium enabling cavitating bubbles to form. Hydrodynamic cavitation cracks the fuel while also producing radicals from the water (e.g., oxygen, hydrogen, hydroxyl radicals). Cracking the fuel produces lighter hydrocarbons that may more readily combust in the gas turbine and other combustion applications, while the radicals react with and oxidize undesirable substances in the fuel such as sulfur and vanadium. By oxidizing these undesirable substances, the fuel treatment system 80 is able to remove them from the fluid.

As illustrated, the fuel treatment system 80 includes a fluid source 82 (e.g., a fuel supply 8Z and a fluid source 84 (e.g., a water supply 84). The flow of fuel from the fuel supply 82 may be controlled with a valve 86 and/or pump 87. Similarly, the flow of water from the water supply 84 may be controlled with a valve 88 and/or pump 89. The fuel and water are directed to a T-connection 90 where the fuel and water mix and form a combined fluid. To facilitate mixing between the fuel and the water, the water and/or the heavy fuel may be heated. For example, a heater 92 may heat the fuel to reduce the viscosity of the fuel for mixing. The water may also be heated with heater 94. The heated water may transfer heat to the fuel as the water and fuel mix. The heat transfer from the water to the fuel similarly reduces the viscosity of the fuel, which facilitates mixing. Heating increases the temperature of the fluid which may facilitate hydrodynamic cavitation.

After combining the fuel and water, the mixture then enters a pump 95, which pumps the fluid into a hydrodynamic cavitation reactor 96. The hydrodynamic cavitation reactor 96 cavitates the fluid, using the water in the mixture as the primary cavitation medium. Cavitation of mixture creates bubbles that then collapse releasing significant amounts of localized energy that can crack hydrocarbon chains. As the water molecules split, free radicals are created (e.g., hydrogen, peroxy, oxygen). The free radicals combine with substances in the fuel, such as sulfur, nickel and vanadium, to form oxides. The mixed fluid is then directed to a separator 98 (e.g., gravity separator or a mechanical separator). The separator 98 enables the substances in the mixture to separate due to their different densities. The hydrocarbon chains in the fuel are less dense than the water enabling the fuel 100 to float to the top of the separator 98. The fuel 100 is then drawn out of the separator 98 through an outlet 101 for later combustion. The oxides formed from the combination of radicals with the undesirable substances (e.g., sulfur, vanadium, nickel, calcium, iron, silica, aluminum) in the fuel 100, some dissociate from the fluid mixture and forms sludge and any soluble oxides that dissolve in the water (e.g., H2SO4, HSO3). These oxides have a density greater than the water and the fuel 100 and therefore descend to the bottom of the separator 98. These substances form a sludge 102 at the bottom of the separator 98, which is then removed and disposed of. In this way, the fuel treatment system 80 may reduce the amount of undesirable substances (e.g., sulfur, vanadium, nickel, calcium, iron, silica, aluminum) in the emissions from a gas turbine, marine engine or fuel treatment plants.

The water 104 exits the separator 98 through an outlet 106. As illustrated, the outlet 106 is between the top and bottom of the separator 98, which blocks and/or reduces the fuel 100 and the heavier sludge from exiting the separator 98 through the water outlet 106. The water 104 exiting the separator 98 may then be disposed of or reused in the process. For example, the water 104 may be directed through a water remediation system 108. The water remediation system 108 may remove undesirable substances from the water 104 (e.g., ash, sulfur, vanadium) embodiments, the water remediation system 108 may include a cyclone separator that removes these undesirable substances from the water 104.

The fuel treatment system 80 may include multiple valves for controlling the flow of fluids. For example, the fuel treatment system 80 may include a valve 110 that controls the amount of fluid exiting the hydrodynamic cavitation reactor 96 to separator 98. A bypass channel is connected from outlet of cavitation reactor to inlet of the reactor to facilitate recirculation of fluid for multiple passes of liquid into the cavitation reactor. The outlet valve 110 may be used to control the recirculation of flow. The fuel treatment system 80 may also include a valve 112 that controls the flow of water 104 out of the separator 98. In some embodiments, the fuel treatment system 80 may also include a valve 114 that controls the flow of water 104 out of the water remediation system 108. A one-way valve may also be included to block the backflow of water through the water remediation system 108 and/or water from the water supply 84 from flowing through the water remediation system 108.

The fuel treatment system 80 may include a controller 118 that controls the flow of water, fuel, and mixtures thereof through the fuel treatment system 80. The controller 118 may also control the ratio of water to fuel entering the hydrodynamic cavitation reactor 96. The controller 118 includes one or more processors 120, such as the illustrated microprocessor, and one or more memory devices 122. The controller 118 may also include one or more storage devices and/or other suitable components. The processor 120 may be used to execute software, such as software that processes signals from a sensor 124 that emits a signal indicative of the composition of the mixture entering the hydrodynamic cavitation reactor 96 (e.g., ratio of fuel to water). By monitoring the ratio, the controller 118 may facilitate the cracking of fuel as well as removal of undesirable substances from the fuel. For example, a desired ratio of fuel to water may be between 5-40% fuel to 60-95% water.

The processor 120 may include multiple microprocessors, one or more "general-purpose" microprocessors, one or more special-purpose microprocessors, and/or one or more application specific integrated circuits (ASICS), or some combination thereof. For example, the processor 120 may include one or more reduced instruction set (RISC) processors.

Memory device 122 may include a volatile memory, such as random access memory (RAM), and/or a nonvolatile memory, such as read-only memory (ROM). Memory device 122 may store a variety of information and may be used for various purposes. For example, memory device 122 may store processor executable instructions (e.g., firmware or software) for the processor 120 to execute. The storage device(s) (e.g., nonvolatile memory) may include ROM, flash memory, a hard drive, or any other suitable optical, magnetic, or solid-state storage medium, or a combination thereof. The storage device(s) may store data, instructions, and any other suitable data.

Figure 3:
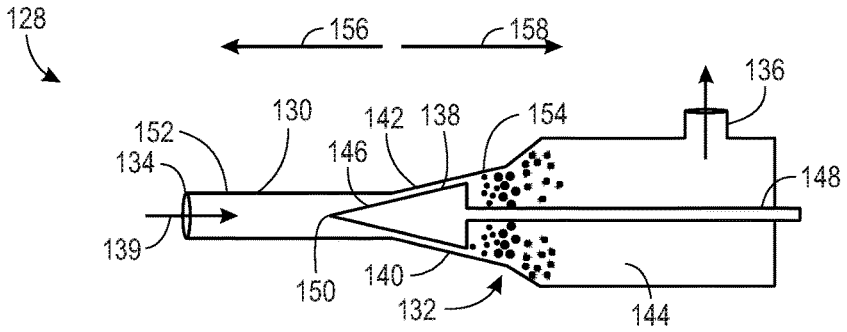
FIG. 3 is a cross-sectional view of a hydrodynamic cavitation reactor, according to an embodiment of the disclosure.

FIG. 3 is a cross-sectional view of a hydrodynamic cavitation reactor 128. The hydrodynamic cavitation reactor 128 includes a body 130 that defines a cavity 132. The cavity 132 extends between an inlet 134 and an outlet 136. Placed within the cavity 132 is an obstruction 138. The obstruction 138 is placed within the cavity to form a restriction in the flow path of a fluid 139 (e.g., fuel and water mixture). More specifically, the obstruction 138 forms a narrow passage 140 (e.g., circumferential passage) between the obstruction 138 and an interior surface 142 of the body 130. As the fluid flows through the narrow passage 140, the velocity of the fluid increases and the static pressure decreases. The rapid decrease in the static pressure, lower than vapor pressure of the fluid, enables bubbles to form in the fluid. During and after flowing past the obstruction 138, the fluid slows as it enters a portion 144 of the cavity 132. The portion 144 defines a volume greater than the narrow passage 140. As the fluid slows in the portion 144 the static pressure increases. The increase in pressure collapses the bubbles. As explained above, the collapse of the bubbles releases significant amounts of localized energy that can crack hydrocarbon chains, generate oxidative radicals and promotes cavitation assisted chemical reactions. As the water molecules split, free radicals are created (e.g., hydrogen peroxy, oxygen). The free radicals combine with substances in the fuel, such as sulfur and vanadium, to form oxides.

As illustrated, the obstruction 138 includes a head 146 coupled to a shaft 148. The head 146 may define a conical or pyramid shape with a tip 150 facing the direction of flow. The head 146 extends into a tube portion 152 and into a truncated conical portion 154 (i.e., truncated conical interior surface) of the body 130. In operation, the shaft 148 may move in axial directions 156 and 158 to increase or decrease the size of the narrow passage 140. By increasing and decreasing the size of the narrow passage 140 the hydrodynamic cavitation reactor 128 increases or decreases the velocity of the fluid enabling the cavitation of different fluids (e.g., fluids with different vapor pressures and boiling temperatures).

Figure 4:
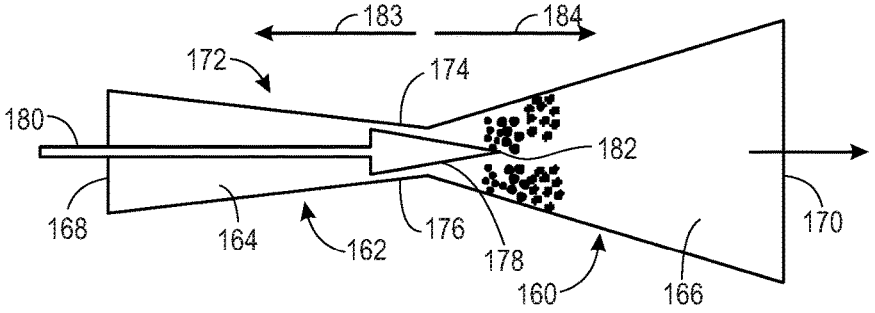
FIG. 4 is a cross-sectional view of a hydrodynamic cavitation reactor, according to an embodiment of the disclosure.

FIG. 4 is a cross-sectional view of a hydrodynamic cavitation reactor 160. The hydrodynamic cavitation reactor 160 includes a body 162. The body 162 defines a first truncated cavity 164 and a second truncated cavity 166 that fluidly connect. Fluid flows through the hydrodynamic cavitation reactor 160 from the inlet 168 to the outlet 170. To facilitate cavitation of the fluid, the hydrodynamic cavitation reactor 160 includes the obstruction 172. The obstruction 172 is placed within the first truncated cavity 164 to form a restriction in the flow path of a fluid (e.g., fuel and water mixture) flowing through the hydrodynamic cavitation reactor 160. More specifically, the obstruction 172 forms a narrow passage 174 (e.g., circumferential passage) between the obstruction 172 and an interior surface 176 of the body 162. As the fluid flows through the narrow passage 174, the velocity of the fluid increases and the static pressure decreases. The rapid decrease in the static pressure to below vapor pressure of fluid results in boiling and formation of vapor bubbles in the fluid. After exiting the narrow passage 174, the fluid enters the second truncated cavity 166 wherein the fluid slows as the volume increases. As the fluid slows the static pressure increases. The increase in pressure collapses the bubbles. As explained above, the collapse of the bubbles releases significant amounts of localized energy that can crack hydrocarbon chains and promotes cavitation assisted chemical reactions.

As illustrated, the obstruction 172 includes a head 178 coupled to a shaft 180. The head 178 may define a conical or pyramid shape with a tip 182 facing the direction of flow. The head 178 may extend through the first truncated cavity 164 and into the second truncated cavity 166. In operation, the shaft 180 may move in axial directions 183 and 184 to increase or decrease the size of the narrow passage 174. By increasing and decreasing the size of the narrow passage 174 the hydrodynamic cavitation reactor 160 increases or decreases the velocity of the fluid enabling the cavitation of different fluids (e.g., fluids with different vapor pressures and boiling temperatures). In some embodiments, the obstruction 172 may be reversed, depending on the direction of fluid flow, with the obstruction extending through the second truncated cavity 166 and into the first truncated cavity 164.

Figure 5:
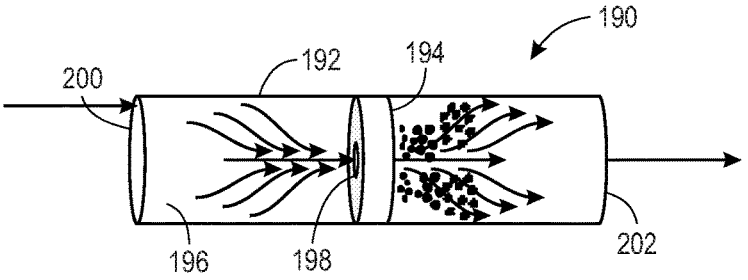
FIG. 5 is a cross-sectional view of a hydrodynamic cavitation reactor, according to an embodiment of the disclosure.

FIG. 5 is a cross-sectional view of a hydrodynamic cavitation reactor 190. The hydrodynamic cavitation reactor 190 includes a conduit 192 (e.g., tube) with an obstruction 194 (e.g., plate) within a cavity or chamber 196 of the conduit 192. The obstruction 194 defines one or more apertures 198 (e.g., 1, 2, 3, 4, 5, 10 or more) that enables fluid to pass through the obstruction as it flow from an inlet 200 to an outlet 202. As the fluid flows through the aperture 198, the velocity of the fluid increases and the static pressure decreases below vapor pressure of a fluid. The rapid decrease in the static pressure results in boiling and forms bubbles in the fluid. After passing through the aperture 198, the fluid enters a larger volume. As the fluid slows the static pressure increases. The increase in pressure collapses the bubbles. As explained above, the collapse of the bubbles releases significant amounts of localized energy that can crack hydrocarbon chains and promotes cavitation assisted chemical reactions.

Figure 6:
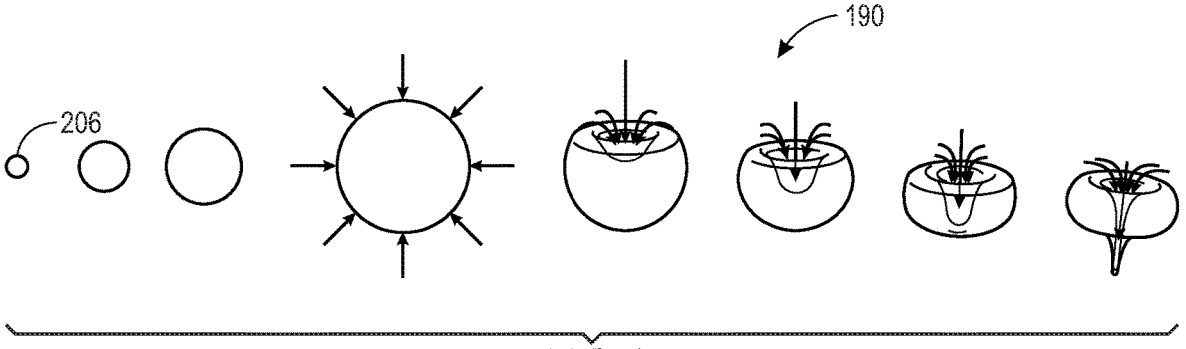
FIG. 6 is a schematic of the cavitation process, according to an embodiment of the disclosure.

FIG. 6 is a schematic of the cavitation process 204. The cavitation process begins by rapidly decreasing the pressure of a liquid to below the saturation vapor pressure. The decrease in pressure causes evaporation or boiling of a fluid to form a cavity or bubble of vapor 206. The bubble 206 grows until the surrounding pressure causes the bubble to collapse. The bubble then rapidly collapses, which increases the pressure and temperature locally. The vapor then dissipates into the surrounding fluid through high energy microjets. The temperatures and pressures created by the collapse of the bubble may be up to 10,000 Kelvin and 1000 Atmospheres. The energy created by these temperatures and pressures enables cracking hydrocarbon chains and promotes cavitation chemistry. As the water molecules split, free radicals are created (e.g., hydrogen, peroxy, oxygen). The free radicals combine with substances in the fuel, such as sulfur, nickel and vanadium, to form oxides. These oxides dissolve in the water or dissociate from the fluid enabling their separation and retrieval in a gravity separator.

Figure 7:
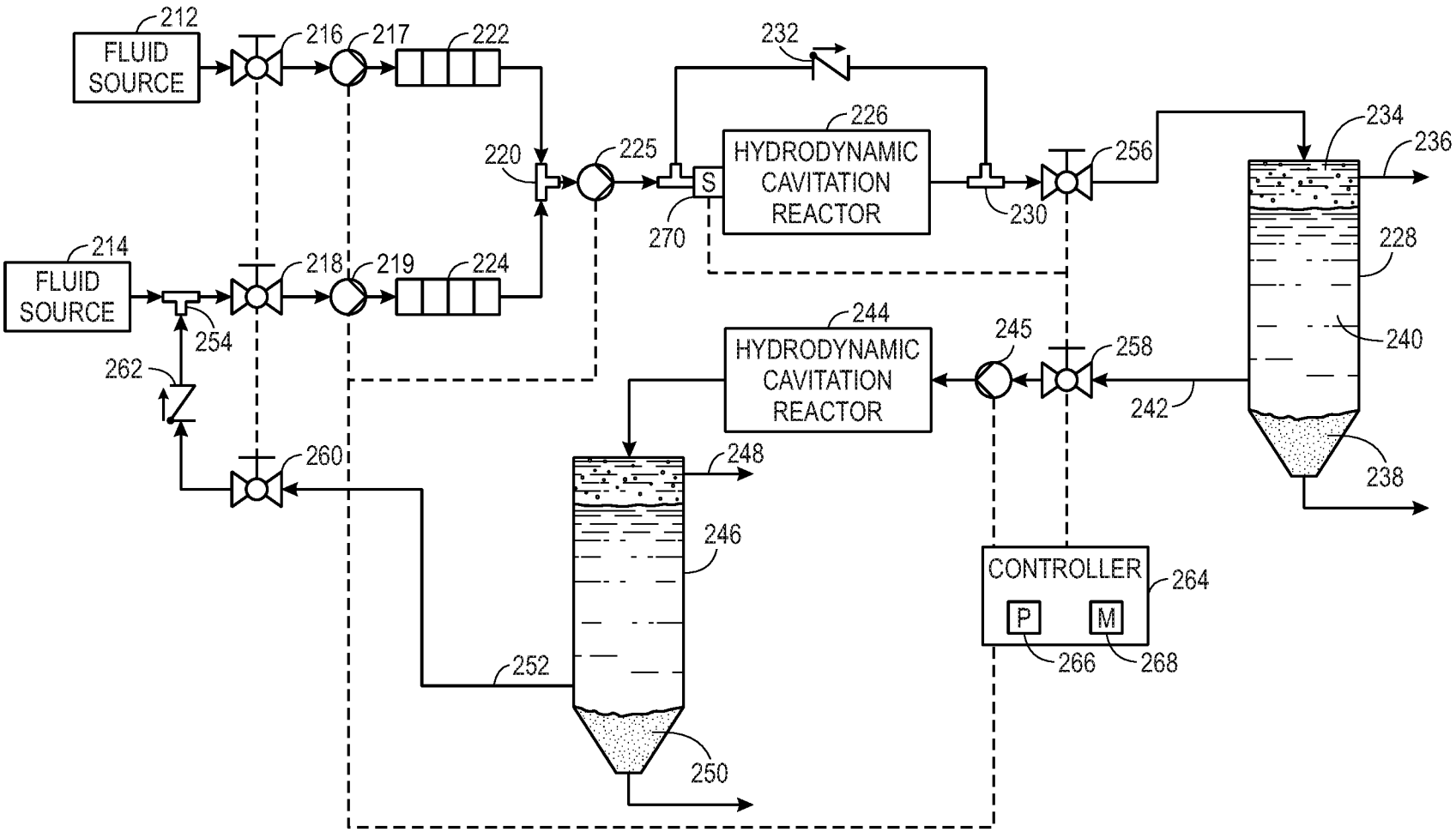
FIG. 7 is a schematic of a fuel treatment system, according to an embodiment of the disclosure.

FIG. 7 is a schematic of a fuel treatment system 210. The fuel treatment system 210 uses hydrodynamic cavitation to cavitate a fluid. For example, the fluid may be a combination of fuel and water. In this mixture, the water may be the primary cavitation medium enabling cavitating bubbles to form. The hydrodynamic cavitation can crack the fuel while also producing radicals from the water (e.g., hydrogen, peroxy, oxygen radicals). As explained above, cracking fuel produces lighter hydrocarbons that may more readily combust in the gas turbine, while the radicals react with and oxidize undesirable substances in the fuel such as sulfur, nickel and vanadium. By oxidizing these undesirable substances, the fuel treatment system 210 is able to remove them from the fluid.

The fuel treatment system 210 includes a fluid source 212 (e.g., a fuel supply 212) and a fluid source 214 (e.g., a water supply 214). The flow of fuel from the fuel supply 212 may be controlled with a valve 216 and/or pump 217. Similarly, the flow of water from the water supply 214 may be controlled with a valve 218 and/or pump 219. The fuel and water are directed to T-connection 220 where the fuel and water mix and form a single fluid. To facilitate mixing between the fuel and the water, the water and/or the heavy fuel may be heated. For example, a heater 222 may heat the fuel to reduce the viscosity of the fuel to facilitate mixing. The water may also be heated with heater 224. The heated water may transfer heat to the fuel as the water and fuel mix. The heat transfer from the water to the fuel reduces the viscosity of the fuel, which facilitates mixing of the water and the fuel. Heating increases the temperature of fluid which facilitates hydrodynamic cavitation.

After combining the fuel and water, the mixture then flows to a pump 225, which then pumps the mixture into a first hydrodynamic cavitation reactor 226. In some embodiments, a pump 227 may pump the mixture into the first hydrodynamic cavitation reactor 226. The first hydrodynamic cavitation reactor 226 cavitates the fluid, using the water in the mixture as the primary cavitation medium. Cavitation of the mixture creates bubbles that then collapse releasing significant amounts of localized energy that crack hydrocarbon chains and promotes cavitation assisted chemical reactions. As the water molecules split, free radicals are created (e.g., hydrogen peroxy, oxygen). The free radicals combine with substances in the fuel, such as sulfur and vanadium, to form oxides. The mixed fluid is then directed to a first separator 228 (e.g., gravity separator). In some embodiments, after exiting the first separator 228, the fluid may flow through a T-connection 230 that may redirect some of the fluid exiting the first hydrodynamic cavitation reactor 226 back to the first hydrodynamic cavitation reactor 226. As the fluid flows back to the first hydrodynamic cavitation reactor 226 it flows through a one-way valve 232. Valve 256 may be used to control bypass flowrates to alter recirculation volume of flow into cavitation reactor 226 to treat the fluid multiple times.

The first separator enables the substances in the mixture to separate due to their different densities. The hydrocarbon chains are less dense than the water, which enables the fuel 234 to float to the top of the first separator 228. The fuel 234 is then drawn out of the first separator 228 through an outlet 236 for use as a fuel. The oxides, formed by the combination of radicals with the undesirable substances (e.g., sulfur, vanadium, nickel, calcium, iron) in the fuel 234, dissociate from the fluid mixture. These oxides have a density greater than the water and the fuel 234 and therefore descend to the bottom of the first separator 228. These substances form a sludge 238 at the bottom of the first separator 228, which is removed and disposed of. In this way, the fuel treatment system 210 may reduce the amount of undesirable substances (e.g., sulfur, vanadium, nickel, calcium, iron) in the emissions from a gas turbine that burns fuel.

The water 240 exits the first separator 228 through an outlet 242. As illustrated, the outlet 242 is between the top and bottom of the first separator 228, which blocks and/or reduces the fuel 234 (i.e., less dense) and the heavier sludge 238 from exiting the first separator 228 through the outlet 242. The water 240 exiting the first separator 228 may then be directed to a mechanical water remediation system or a second hydrodynamic cavitation reactor 244 to remediate water. The fluid exits the water remediation system and enters a second separator 246 (e.g., gravity separator). In some embodiments, the fuel treatment system 210 may include a pump 245, the pump 245 may maintain a desired pressure through the second hydrodynamic cavitation reactor 244 to facilitate cavitation of the fluid.

In the second separator 246, the fluid again separates. The fuel 234 floats to the top of the second separator 246. The fuel 234 is then drawn out of the second separator 246 through an outlet 248. The oxides formed from the combination of radicals with the undesirable substances (e.g., sulfur, vanadium) in the fuel 234, dissociate from the fluid mixture. These oxides fall to the bottom of the second separator 246 and form a sludge 250 at the bottom of the second separator 246, which is removed and disposed of. The water 240 exits the second separator 246 through the water outlet 252. The water 240 may then be reused to treat more fuel 234. For example, the water 240 may be redirected to the T-connection 254 where it is mixed with additional fuel flowing from the fuel supply 212.

The fuel treatment system 210 may include multiple valves for controlling the flow of fluids (e.g., valve 256, valve 258). For example, the fuel treatment system 210 may include a valve 256 that controls the amount of fluid exiting the first hydrodynamic cavitation reactor 226. The fuel treatment system 210 may also include a valve 258 that controls the flow of water 240 out of the first separator 228. In some embodiments, the fuel treatment system 210 may also include a valve 260 that controls the flow of water 240 out of the second separator 246. A one-way valve 262 may also be included to block the backflow of water through the second separator 246 and/or water from the water supply 214 from flowing through the second separator 246.

The fuel treatment system 210 may include a controller 264 that controls the flow of water, fuel, and mixtures thereof through the fuel treatment system 210. The controller 264 may also control the ratio of water to fuel entering the first hydrodynamic cavitation reactor 226. The controller 264 includes one or more processors 266, such as the illustrated microprocessor, and one or more memory devices 268. The controller 264 may also include one or more storage devices and/or other suitable components. The processor 266 may be used to execute software, such as software that processes signals from a sensor 270 that emits a signal indicative of the composition of the mixture entering the first hydrodynamic cavitation reactor 226 (e.g., ratio of fuel to water). By monitoring the ratio, the controller 264 may facilitate the fuel cracking as well as removal of undesirable substances from the fuel. For example, a desired ratio of fuel to water may be between 5-40% fuel to 60-95% water.

Technical effects of the invention include a fuel treatment system that enables removal of undesirable substances (e.g., sulfur, vanadium, nickel, calcium, iron) from fuel. The fuel treatment system cavitates the fluid hydrodynamically or in other words without ultrasound waves. By hydrodynamically cavitating the fluid, the fuel treatment system is able to treat the fuel without using catalysts to react with and facilitate the removal of undesirable substances.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

The invention claimed is:

1. A system comprising:

a fuel treatment system, comprising:

a hydrodynamic cavitation reactor configured to receive a fluid that comprises fuel from a fuel supply and water from a water supply, wherein the hydrodynamic cavitation reactor is configured to cavitate the fluid, and wherein cavitation of the fluid is configured to crack the fuel and form radicals that combine with one or more substances in the fuel to form one or more combined substances;

a separator configured to receive the fluid, and wherein the separator is configured to separate the fluid into the water, the fuel, and the one or more combined substances; and a water remediation module configured to receive the water from the separator.

2. The system of claim 1, wherein the fuel supply comprises crude oil, distillate oil, residual oil, shale oil, tar sands, and/or hydrocarbon slurries.

3. The system of claim 1, wherein the one or more substances comprises sulfur, vanadium, nickel, calcium, iron, aluminium and/or silica.

4. The system of claim 1, wherein the separator comprises a gravity separator or mechanical separator.

5. The system of claim 1, wherein the hydrodynamic cavitation reactor comprises a fluid flow path in a body, an obstruction disposed in the fluid flow path, and at least one restricted flow path through the obstruction or between the obstruction and an interior surface of the body.

6. The system of claim 1, wherein the water remediation module comprises a cyclone separator configured to remove particulate from the water.

7. The system of claim 1, comprising a heater configured to heat the fuel.

8. The system of claim 7, wherein the heater is upstream from the hydrodynamic cavitation reactor.

9. The system of claim 1, comprising a heater configured to heat the water.

10. The system of claim 9, wherein the heater is upstream from the hydrodynamic cavitation reactor.

11. A system comprising:

a fuel treatment system, comprising:

a first hydrodynamic cavitation reactor configured to receive a first fluid that comprises fuel from a fuel supply and water from a water supply, wherein the first hydrodynamic cavitation reactor is configured to cavitate the first fluid, and wherein cavitation of the first fluid is configured to crack the fuel and form radicals that combine with one or more substances in the fuel to form one or more combined substances;

a first separator configured to receive the first fluid from the first hydrodynamic cavitation reactor, and wherein the first separator is configured to separate the one or more combined substances from the first fluid;

a second hydrodynamic cavitation reactor configured to receive a second fluid comprising water from the first separator, wherein the second hydrodynamic cavitation reactor is configured to cavitate the second fluid; and a fluid path coupled to an outlet of the second hydrodynamic cavitation reactor and an inlet of the first hydrodynamic cavitation reactor.

12. The system of claim 11, comprising a second separator disposed along the fluid path and configured to receive the second fluid from the second hydrodynamic cavitation reactor, wherein the second separator is configured to separate the water from the second fluid and direct the water along the fluid path to the inlet of the first hydrodynamic cavitation reactor.

13. The system of claim 12, wherein the second separator comprises a gravity separator.

14. The system of claim 11, wherein the first separator comprises a gravity separator.

15. The system of claim 11, comprising a heater configured to heat the fuel prior to cavitation in the first hydrodynamic cavitation reactor.

16. The system of claim 11, wherein the first hydrodynamic cavitation reactor comprises an obstruction disposed in a fluid flow path in a body, wherein the obstruction comprises a plate having one or more apertures or a conical head coupled to a shaft.

17. A system comprising:

a gas turbine configured to drive a generator;

a fuel supply configured to supply fuel to the gas turbine;

a water supply;

a fuel treatment system configured to remove substances from the fuel using water from the water supply, the fuel treatment system comprises:

a hydrodynamic cavitation reactor configured to receive a fluid that comprises fuel from the fuel supply and water from the water supply, wherein the hydrodynamic cavitation reactor is configured to cavitate the fluid, and wherein cavitation of the fluid is configured to crack the fuel and form radicals that combine with the substances in the fuel to form combined substances;

a separator configured to receive the fluid, and wherein the separator is configured to separate the fluid into the water, the fuel, and the combined substances; and a water remediation module configured to receive the water from the separator.

18. The system of claim 17, wherein the separator comprises a gravity separator.

19. The system of claim 17, wherein the water remediation module comprises a cyclone separator.

20. The system of claim 17, comprising a heater configured to heat the fuel.

* * * * *